United States Patent [19]

Gazzano et al.

[11] Patent Number: 4,815,147

[45] Date of Patent: Mar. 28, 1989

[54] HIGH FLEXIBILITY PROTECTIVE GLOVE

[75] Inventors: Rick Gazzano, San Carlos, Calif.; John Pagotto, Laval, Canada

[73] Assignee: Easton Sports, Burlingame, Calif.

[21] Appl. No.: 156,892

[22] Filed: Feb. 17, 1988

[51] Int. Cl.[4] ..... A41D 13/10

[52] U.S. Cl. ..... 2/161 A

[58] Field of Search ..... 2/20, 21, 161 A, 161 R, 2/163

[56] References Cited

U.S. PATENT DOCUMENTS

| | | | |
|---|---|---|---|
| 4,411,024 | 10/1983 | Hayes | 2/20 |
| 4,484,359 | 11/1984 | Tirinen | 2/161 X |
| 4,497,073 | 2/1985 | Deutsch | 2/162 X |
| 4,677,698 | 7/1987 | Angas | 2/161 |

*Primary Examiner*—Werner H. Schroeder
*Assistant Examiner*—S. Current
*Attorney, Agent, or Firm*—Flehr, Hohbach, Test, Albritton & Herbert

[57] ABSTRACT

A hockey glove (40) has a set of knuckle protective pads (42) which follow the position of the player's knuckles beneath the pads (42). Break lines (44) are arcuate in shape and incline rearwardly toward wrist portion (46) of the glove (40) from base (48) of thumb portion (50) of the glove (40). Break lines (52) extend between the break lines (44) and are inclined at an acute angle relative to longitudinal direction (54) of the glove (40). Break lines (56) between protective pads (57) on fingers (58) of the glove correspond to the different positions of middle joints on the player's hand, i.e., they are not positioned in a straight line. The rear break line (44) separates the protective pads (42) from protective pad (43) for the back of the wearer's hand. The construction of the protective pads (42) and (57) and the break lines (44, 52 and 56) on the glove 40 allows the player to grasp hockey stick (20) in a natural grip.

4 Claims, 5 Drawing Sheets

HIGH FLEXIBILITY PROTECTIVE GLOVE

BACKGROUND OF THE INVENTION

1. Field of the Invention

This invention relates to an improved form of a protective glove that is highly flexible in response to movement of a wearer's hand. More particularly, it relates to such a glove that will allow the user's hand to be positioned in a natural manner when grasping objects while wearing the glove. Most especially, it relates to such a glove which is suitable for use as a hockey glove.

2. Description of the Prior Art

A variety of special purpose gloves have been developed for various sports and outdoor activities, such as hockey, lacrosse and skiing. These gloves must offer substantial protection for the wearer, either against impacts on the hands or cold. At the same time, such activities require the wearer of the gloves to be able to move his or her fingers for grasping a hockey or lacrosse stick or a ski pole. Flexibility is also required at the wrist to be able to execute rapid moves of the hockey or lacrosse stick as required in play. Because hockey and lacrosse are rough sports involving a substantial amount of contact with opposing players and their sticks, such as when checking an opponent, hockey and lacrosse gloves have substantial padding for the hand, which extends along the arm to cover the wrist and is designed to be laced around the wrist and lower forearm. The need to provide such padding and the need for a high degree of flexibility are somewhat contradictory. In fact, many hockey players will remove the lacing from conventional hockey gloves in order to obtain desired flexibility at the wrist, which exposes the wrist to an increased risk of injury.

Examples of prior art sport gloves are shown and described in the following issued patents and publications: U.S. Pat. No. 3,605,117, issued Sept. 20, 1971 to Latina; U.S. Pat. No. 3,997,922, issued Dec. 21, 1976 to Huhta; U.S. Pat. No. 4,497,073, issued Feb. 5, 1985 to Deutsch; U.S. Pat. No. 4,541,127, issued Sept. 17, 1985 to Gould; U.S. Pat. No. 4,677,698, issued July 7, 1987 to Angas; U.S. Des. Pat. No. 257,909, issued Jan. 20, 1981 to Brine; U.K. No. 670,862, issued Apr. 23, 1952 to Gamet; French U.S. Pat. No. 1,109,306, issued Jan. 24, 1956 to Cuir-Sic S.A. and West German Offenlegungsschrift No. 3,135,756, published Apr. 14, 1983 by Reusch. As can be seen in this prior art, flexibility is obtained in the padding at the fingers of such gloves by providing a plurality of parallel break lines extending perpendicular to the fingers of the gloves. While such parallel break lines allow the wearer's fingers to be curved to grasp a hockey or lacrosse stick or a ski pole, the flexibility thus obtained does not correspond to the natural position of the wearer's fingers when grasping such objects. As a result, the prior art gloves continue to bind the user's hand in use of the gloves.

The Huhta patent discloses the use of flexible inserts of pleated material in the fingers and at the knuckles of ski gloves to increase the grasping flexibility of the gloves, but such an approach would not be suitable for hockey or lacrosse gloves, since it would leave substantial areas of the gloves without the thick padding provided in such gloves. The Deutsch patent shows a lacrosse glove with a flexible cuff portion obtained by joining the cuff to the hand of the glove by a strip of flexible material, but this design provides increased flexibility at the expense of protection at the wrist. The Angas patent provides increased flexibility at the cuff of a hockey glove by providing triangular portions of the cuff, which move in a hinging action as the user's wrist flexes. While this design provides some increase in flexibility, it would be advantageous to increase the amount of flexibility still further without sacrificing wrist protection.

SUMMARY OF THE INVENTION

Accordingly, it is an object of this invention to provide an improved protective glove which provides flexibility for grasping objects and matches the normal positioning of the fingers when grasping such objects as sticks and poles.

It is another object of the invention to provide such a glove which includes protection for the wearer's wrist while also providing a high degree of flexibility at the wrist.

It is another object of the invention to provide such a glove in which the user's fingers are positioned with the tips of the wearer's fingers at the end of the glove fingers both when the fingers are straight and when they are curved to grasp an object.

The attainment of these and related objects may be achieved through use of the novel protective glove herein disclosed. A glove in accordance with this invention has a flexible enclosure for a wearer's hand including thumb and fingers. A first plurality of protective pads are attached to the flexible enclosure and positioned to have one of the first plurality of protective pads over each knuckle of the wearer's hand when the glove is worn. At least one first protective pad is attached to the flexible enclosure and positioned to be over a back of the wearer's hand when the glove is worn. A second plurality of protective pads is attached to the flexible enclosure and positioned to have at least two of the second plurality of protective pads be over the wearer's fingers when the glove is worn. The first plurality of protective pads is separated from the at least one protective pad by a first break line extending from a base of the thumb of the enclosure and is positioned to extend at an angle across the back of the wearer's hand toward the wearer's wrist when the glove is worn. The first plurality of protective pads are separated from the second plurality of protective pads by a second break line extending from the base of the thumb of the enclosure in front of the first plurality of protective pads at an angle toward the wearer's wrist when the glove is worn. The first plurality of protective pads are separated from one another by a first plurality of break lines extending between adjacent ones of the first plurality of protective pads from the first break line to the second break line at an acute angle relative to a longitudinal extending direction of the glove.

This construction and placement of the protective pads and arrangement of the break lines gives the glove flexibility in the proper directions so that the wearer can grasp a hockey stick or ski pole in a natural grip.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1B:
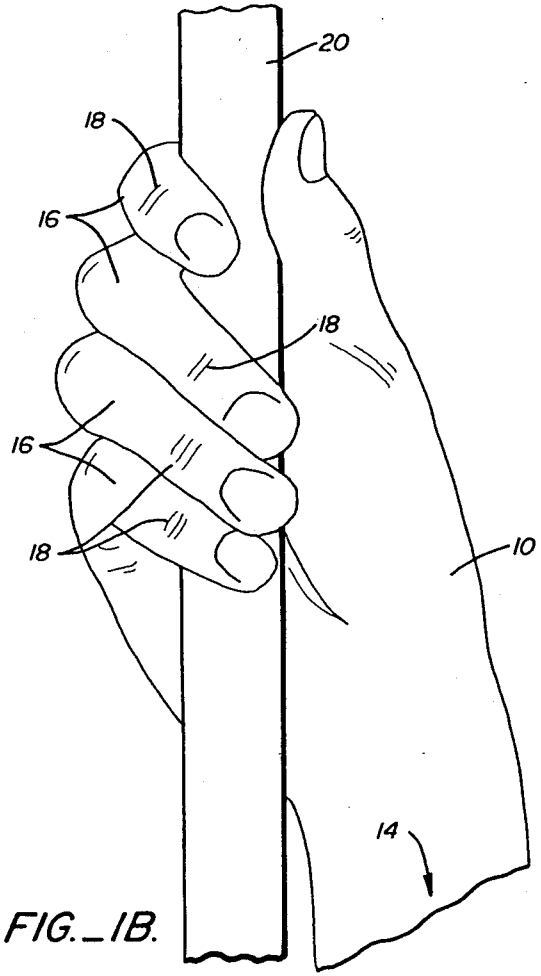
FIG. 1B is another front view of a hand grasping another object, useful for further understanding the invention.
Figure 1A:
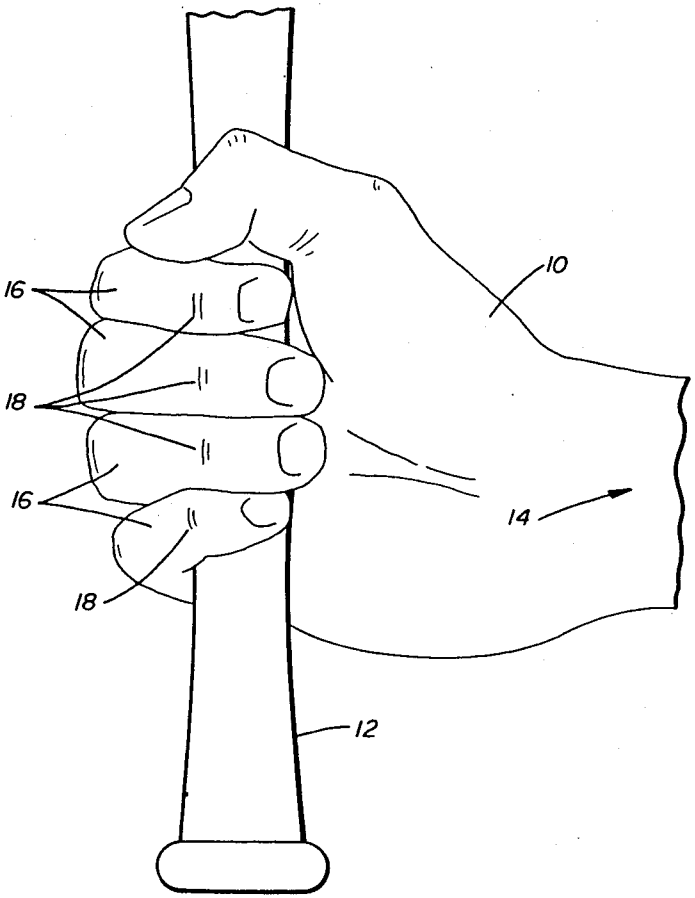
FIG. 1A is a front view of a hand grasping an elongated object, useful for understanding the present invention.

Turning now to the drawings, more particularly to FIG. 1A, there is shown a user's hand 10 grasping a baseball bat 12, with the bat 12 generally perpendicular to the extending direction of the user's forearm 14. Note that fingers 16 are generally parallel to the extending direction of the forearm 14 and that distal joints 18 of the fingers 16 are in a straight line along the bat 12. In FIG. 1B, the user's hand 10 is shown grasping a hockey stick 20, with the hockey stick 20 extending at an acute angle to the user's forearm 14. Note that the fingers 16 are at an inclined angle relative to the hockey stick 20 and the distal joints 18 are not aligned in a straight line. As the hockey stick is moved to different positions while playing hockey, hand 10 forms different angles with respect to forearm 14. As is more fully explained below, prior art hockey glove construction tends to force the user's hand 10 to utilize a grip of the type shown in FIG. 1A, even though the grip of FIG. 1B is natural for a hockey stick.

Figure 2:
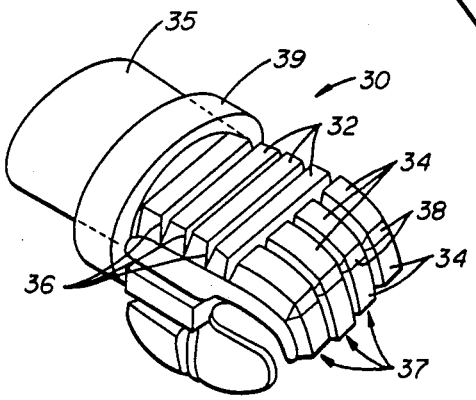
FIG. 2. (PRIOR ART)
FIG. 2 is a perspective view of a prior art hockey glove.

FIG. 2 shows a typical prior art hockey glove 30. The glove 30 has protective pads 32 and 34 respectively for the back of the user's hand and the user fingers. The protective pads 32 are separated by a set of parallel break lines 36, and the protective pads 34 on each finger 37 are separated by break lines 38, which are parallel to the break lines 36. The break lines 38 extend in a straight line across fingers 37. While the protective pads 32 and 34 and their associated break lines 36 and 38 provide a combination of protection for the player hand against impacts encountered while playing hockey and flexibility for grasping a hockey stick, the rectilinear arrangement of the protective pads 32 and 34 and the break lines 36 and 38 tend to force the player's hand into the grip of FIG. 1A. Since the grip of FIG. 1B is more natural for the hockey stick 20, the result is binding of the glove 30 against the player's hand when the player attempts to use the grip of FIG. 1B. This binding negates the desired flexibility of the glove 30 in use. A cuff 35 extends over the player's lower forearm when the glove 30 is worn. A protective pad 39 covers the cuff 35 where it is connected to the remainder of the glove 30 for wrist protection.

Figure 3A:
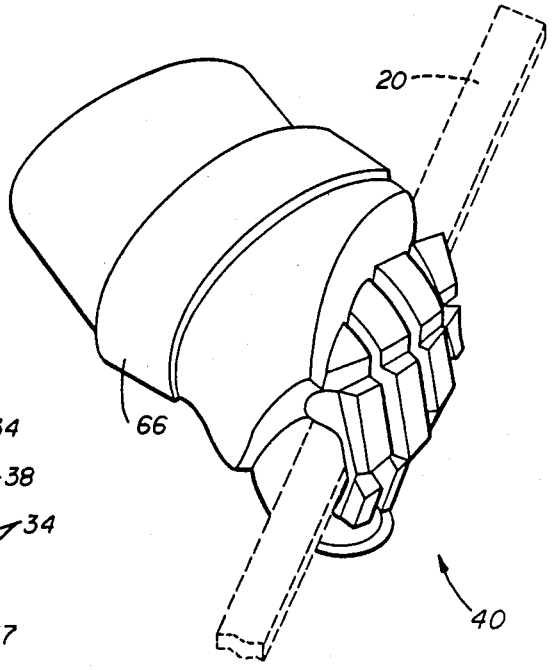
FIG. 3A is another perspective view of the hockey glove in FIG. 3, but in a different position.
Figure 3:
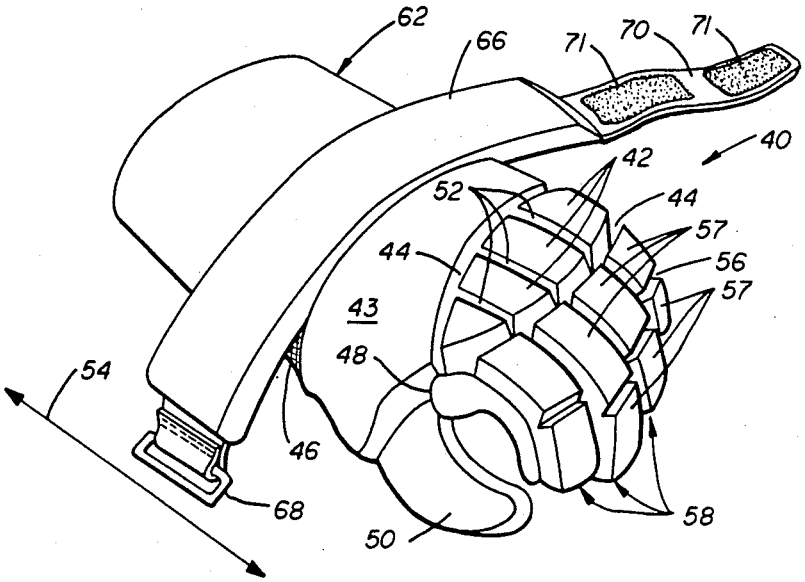
FIG. 3 is a perspective view of a hockey glove in accordance with the invention.
Figure 4:
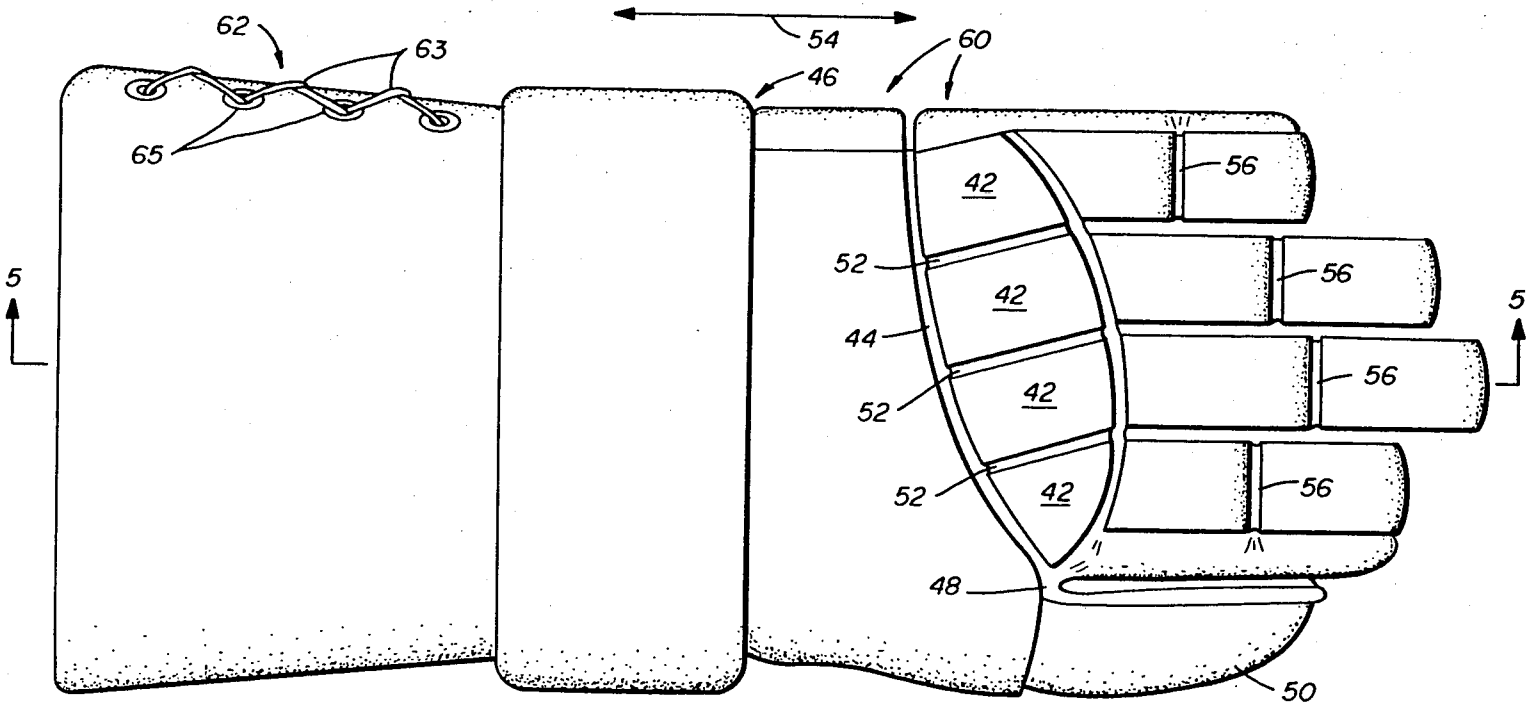
FIG. 4 is a plan view of the hockey glove of FIG. 3.
Figure 5:
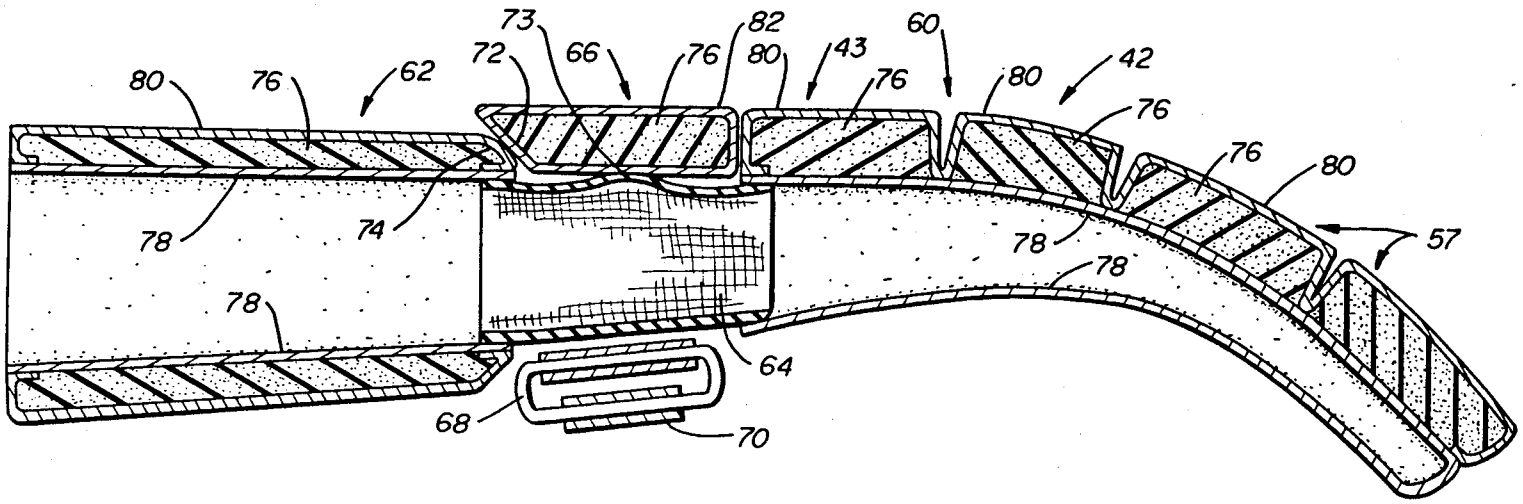
FIG. 5 is a cross-section view, taken along the line 5—5 in FIG. 4.

FIGS. 3, 4 and 5 show a hockey glove 40 having a modified construction to avoid this binding problem encountered with the prior art hockey glove 30. The hockey glove 40 has a set of knuckle protective pads 42 which follow the position of the player's knuckles beneath the pads 42. Break lines 44 are arcuate in shape and incline rearwardly toward wrist portion 46 of the glove 40 from base 48 of thumb portion 50 of the glove 40. Break lines 52 extend between the break lines 44 and are inclined at an acute angle relative to longitudinal direction 54 of the glove 40. Break lines 56 between protective pads 57 on fingers 58 of the glove correspond to the different positions of middle joints on the player's hand, i.e., they are not positioned in a straight line. The rear break line 44 separates the protective pads 42 from protective pad 43 for the back of the wearer's hand. FIG. 3A shows how the construction of the protective pads 42 and 57 and the break lines 44, 52 and 56 on the glove 40 allow the player to grasp the hockey stick 20 in the natural grip as shown in FIG. 1B. The break lines 44, 52 and 56 allow the glove fingers 58 to curve as also shown in in FIG. 1B with the fingers 16, rather than tending to force the fingers 16 to curve as shown in the grip of FIG. 1A, as occurs with the glove 30 of FIG. 2.

Hand portion 60 of the glove 40 is joined to cuff portion 62 by a biaxially stretchable fabric connecting portion 64. The connecting portion 64 allows the cuff portion 62 to articulate both laterally and vertically with respect to the hand portion 60. A protective pad 66 in the form of a strap overlies the top and sides of the connecting portion 64. A buckle 68 and a strap 70 with mating Velcro fastener portions 71 is used to hold the protective pad 66 in place around the connecting portion 64. The protective pad 66 is attached to the connecting portion 64 at 73.

Figure 6A:
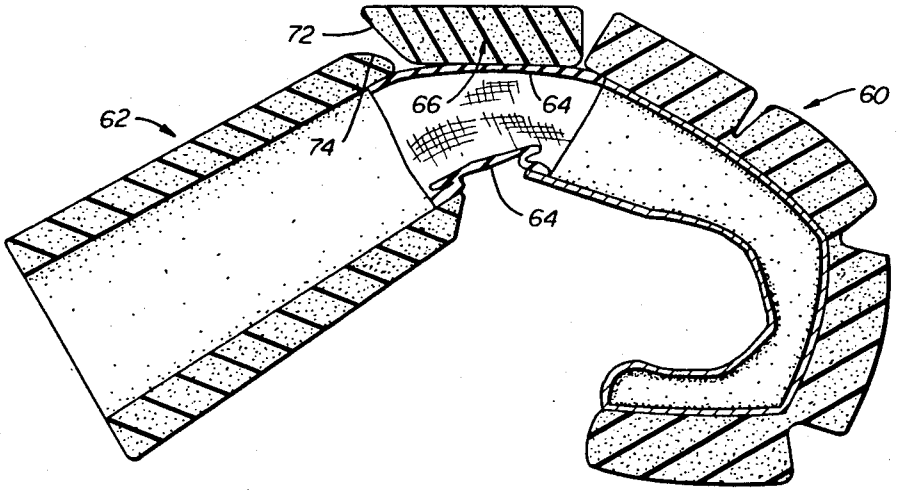
FIG. 6A is another cross-section view similar to FIG. 5, but with the hockey glove in another position.
Figure 6B:
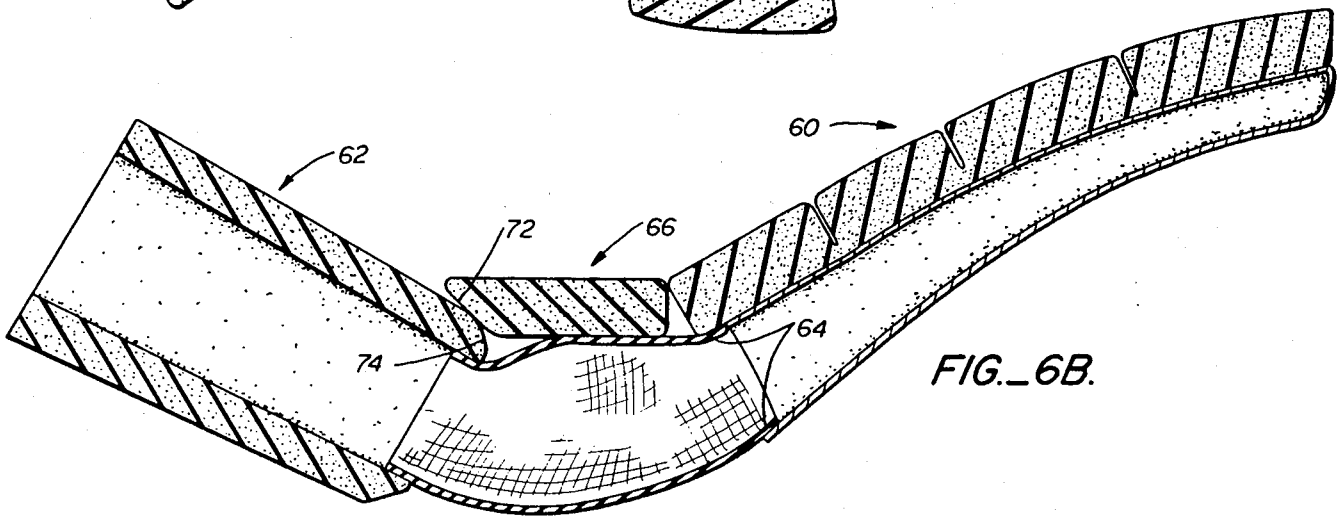
FIG. 6B is a third cross-section view similar to FIGS. 5 and 6A, but with the hockey glove in a third position.

The protective pad 66 has a slanted rear edge 72 which engages a mating slanted edge 74 on the cuff portion 62. FIGS. 6A and 6B show how the slanted edges 72 and 74 separate when the wearer's wrist is bent downward and how the slanted edge 72 rides up on the slanted edge 74 when the wearer's wrist is bent back. A similar action occurs when the wearer wrist is bent laterally. This construction of the protective pad 66 and the cuff portion 62 provides both full protection for the wearer's wrist and full flexibility between the hand portion 60 and the cuff portion 62 of the glove 40. The cuff portion 62 may be tightly attached around the wearer's forearm by means of laces 63 and eyelets 65 (FIG. 4) without interfering with the flexibility between the hand portion 60 and the cuff portion 62.

The protective pads 42, 43 and 57 and the cuff portion 62 have a closed cell foam plastic structure 76 attached to flexible glove body layer 78 and covered by top layer 80. A similar layer 82 covers the structure 76 of the protective pad 66. The layers 78, 80 and 82 are typically vinyl or leather, and the structure 76 may be formed from more than one layer of different foam plastic, to give a combination having desired properties. Alternatively, open cell foam and trapped air between the layers 78 and 80 can be used to form the protective pads 42, 57 and 66 and the cuff portion 62, in accordance with the teaching of commonly owned U.S. Pat. No. 4,486,901, issued Dec. 11, 1984 to Donzis.

It should now be readily apparent to those skilled in the art that a novel protective glove capable of achieving the stated objects of the invention has been provided. The protective glove of this invention has increased flexibility so that the wearer can grasp such objects as sticks and poles with a natural grip. The glove provides articulated movement between a hand portion and a cuff portion while maintaining protection for the wearer's wrist. Because the wearer can grasp objects with a natural grip, the wearer's fingers remain properly positioned in the fingers of the glove. While the glove of this invention has been described in the form of a hockey glove, its features should make it of use for a variety of other sports as well, such as lacrosse, baseball, skiing, and the like. A glove in accordance with the invention could also be employed for work and other activities.

It should further be apparent to those skilled in the art that various changes in form and details of the invention as shown and described may be made. It is intended that such changes be included within the spirit and scope of the claims appended hereto.

What is claimed is:

1. A protective glove, which comprises a flexible enclosure for a wearer's and including thumb and fingers, a first plurality of protective pads attached to said flexible enclosure and positioned to have one of the first plurality of protective pads over each knuckle of the wearer's hand when the glove is worn, at least one first protective pad attached to said flexible enclosure and positioned to be over a back of the wearer's hand when the glove is worn, a second plurality of protective pads attached to said flexible enclosure and positioned to have at least two of said second plurality of protective pads be over the wearer fingers when the glove is worn, said first plurality of protective pads being separated from said at least one protective pad by a first break line extending from a base of the thumb of said enclosure and positioned to extend at an angle across the back of the wearer's hand toward the wearer wrist when the glove is worn, said first plurality of protective pads being separated from said second plurality of protective pads by a second break line extending from the base of the thumb of said enclosure in front of said first plurality of protective pads at an angle toward the wearer's wrist when the glove is worn, said first plurality of protective pads being separated from one another by a first plurality of break lines extending between adjacent ones of said first plurality of protective pads from said first break line to said second break line at an acute angle relative to a longitudinal extending direction of the glove.

2. The protective glove of claim 1 in which said first and second break lines are arcuate in configuration.

3. The protective glove of claim 1 in which said second plurality of protective pads are separated from one another on each finger of the glove by one of a second plurality of break lines positioned to be over a joint of each finger of the wearer hand when the glove is worn.

4. The protective glove of claim 1 additionally comprising a cuff portion of said enclosure, at least one second protective pad attached to said cuff portion of said enclosure and positioned to be over the wearer's forearm when the glove is worn, said cuff portion being separated from a hand portion of said enclosure by a strip of flexible material, at least one third protective pad being fastenable over said strip of flexible material, said at least one second protective pad and said at least one third protective pad having facing inclined edges, one of the facing inclined edges being free to move over another of the inclined edges when said cuff portion is articulated with respect to said hand portion.

* * * * *